US006076287A

United States Patent [19]

Savard

[11] Patent Number: 6,076,287

[45] Date of Patent: Jun. 20, 2000

[54] STANCE-SUPPORT ATTACHMENT FOR FREESTYLE SNOWBOARD BOOT

[75] Inventor: Brian Savard, Whistler, Canada

[73] Assignee: Shimano Inc., Sakai, Japan

[21] Appl. No.: 09/069,207

[22] Filed: Apr. 29, 1998

[51] Int. Cl.[7] ..... A43B 5/04

[52] U.S. Cl. ..... 36/118.2; 36/117.1; 36/118.9

[58] Field of Search ..... 36/117.1, 115, 36/118.2, 118.3, 118.4, 118.7, 118.8, 118.1, 119.1, 117.8; 280/14.2

[56] References Cited

U.S. PATENT DOCUMENTS

| | | | |
|---|---|---|---|
| 3,543,421 | 12/1970 | Ader | 36/118.8 |
| 4,367,885 | 1/1983 | Ramer | 280/614 |
| 5,406,721 | 4/1995 | Marcolin | 36/105 |
| 5,560,128 | 10/1996 | Marega et al. | 36/118.7 |
| 5,664,344 | 9/1997 | Marmonier | 36/118.2 |
| 5,713,587 | 2/1998 | Morrow et al. | 280/14.2 |
| 5,894,684 | 4/1999 | Sand et al. | 36/117.1 |
| 5,915,821 | 6/1999 | Okajima et al. | 36/117.1 |
| 5,967,531 | 10/1999 | Saillet | 280/11.36 |
| 5,975,557 | 11/1999 | Snoke et al. | 280/624 |

FOREIGN PATENT DOCUMENTS

| | | |
|---|---|---|
| 0 772 982 A2 | 7/1996 | European Pat. Off. . |
| 36 22 746 A1 | 1/1988 | Germany . |
| MI92A1237 | 5/1992 | Italy . |
| 9-187302 | 7/1997 | Japan . |
| WO97/35494 | 3/1997 | WIPO . |

OTHER PUBLICATIONS

RIDE Snowboards Hardgoods 1999 Dealer Catalog.

K2 Snowboards Inc. 1998/1999 Dealer Catalog.

*Primary Examiner*—J. J. Swann
*Assistant Examiner*—David R. Dunn
*Attorney, Agent, or Firm*—Shinjyu, An Intellectual Property Firm

[57] ABSTRACT

For a freestyle snowboard boot directed to so-called step-in bindings, a stance support system is disclosed, composed principally of a stance support shank; a bearing mount structured to be attachable to a snowboard boot heel counter, supporting a bearing having a bearing surface that is at least partially pivotal; and a shank retainer fitting structured to be attachable to the leg portion of the snowboard boot. One end of the shank is formed as a rocker for riding on the pivotal surface of the bearing, wherein it is rockable from an upright orientation through an instep-ward cant, and is rigidly restrained uprightly from rocking outward beyond the cant. The other end of the shank is a lever end engagable into the retainer fitting. The stance support system is switchable between ride and walk modes, either by configuring the engagement of the lever end of the shank into the retainer fitting such that the entire shank can be withdrawn from the system, or such that the lever end is toggle spring-hinged in the retainer fitting, wherein the shank can be swung between a bearing-riding position and a diametrically opposite walk-mode position. The stance support system is furthermore configured to have a lean adjustment.

15 Claims, 7 Drawing Sheets

STANCE-SUPPORT ATTACHMENT FOR FREESTYLE SNOWBOARD BOOT

BACKGROUND

1. Technical Field

The present invention relates to snowboard boot support systems; in particular it relates to stance-support systems functional on the rear of the bootleg and heel of snowboard boots to govern the various leg movements of a snowboard rider.

2. Description of Background Art

Snowboard riding entails boot binding and support requirements unique among pedestrian snow sports. Broadly, the sport may be divided into alpine and freestyle snowboarding. In alpine snowboarding, hard boots similar to those conventionally used for alpine skiing are worn, fitted into so-called hard bindings mounted on the snowboard, which likewise resemble alpine ski boot bindings. In freestyle snowboarding, soft boots similar to ordinary snow boots, or adaptations of such boots as distinct from hard shell alpine boots, are typically worn, fitted into so-called soft bindings.

For effective control in riding a snowboard, the snowboard rider's feet are bound to the snowboard oblique to the rider's gliding (board longitudinal) direction, establishing the rider's stance, wherein the rider works his or her legs to maneuver the board.

While snowboard boot bindings bind the boots to the board, associated stance support systems have been developed to govern aspects of the attitude of the rider's legs with respect to the snowboard in riding.

Therein, conventional stance support systems having means for adjustably supporting the extent to which the rider's lower legs are bent forward on the ankles (referred to as "lean") are common. Further, mechanisms that govern the sway of the rider's legs in the longitudinal direction of the board (referred to as "cant" or "lateral flex") are also known.

Stance support systems for snowboard boots for soft and for hard binding systems support the upper heel as well as the bootleg rear (rear of the ankle/lower calf) regions. This aspect of leg support provided by either stance support system will hereinafter be referred to as "highback support," using the term familiar in the art.

Thus the highback support in the associated binding systems can govern the lean as well as the cant of the rider's stance. Both lean and cant control in highback support are desirable particularly in freestyle riding, in which the snowboard is piloted through a great variety of orientations on the snow in riding and in hitting the snow coming out of a jump. Highback support aids in steering the board, and in supporting against injury, particularly in landing. Moreover, support in the highback area assists the rider in making what is referred to as backside turns, in which the rider leans back, tilting the snowboard on the longitudinal edge along the boot heels.

A snowboard rider's canting motion is defined by the natural anatomical movements possible in the feet and legs. Specifically, locking the knees or otherwise standing rigidly straight is obviously unstable for riding, and moreover undesirable since the rider cants only by rocking on the balls of the feet, which leads to a loss of steering power applied to the board from the muscles of the legs. By bending the knees, the rider not only gains the stability of the crouch, but is then able to twist the lower legs inward (cant inward) on the ankles. In this canting motion, the sole of the boot remains in fuller contact with the snowboard, to promote transfer of maximum steering control power from the rider's legs to the board.

On the other hand, with the legs bent at the knees, the human ankle is such that it does not allow one to twist the lower leg outward (outward canting) without rolling on the ball of the foot, which likewise leads to a lose of steering power applied to the board from the muscles of the legs. Consequently, asymmetrical highback support has been established in the art to maintain contact between the soles of the boots and the snowboard as fully as possible in riding.

Strap bindings and step-in bindings are established mechanisms for fastening snowboard boots to the boards, for which there are various stance support systems associated. strap bindings are for soft snowboard boots, and releasably strap the boots fast to the board through a binding baseplate or the like. Strap bindings accomplish highback support with a highback element attached to the baseplate. Therein the highback element can further include adjustable lean-setting means. Moreover, as disclosed in German Patent DE 3622746 A1, the highback can also be made pivotable to accommodate supportively lateral flex of the rider's legs.

When unfastened from the binding/highback support element, snowboard boots for strap bindings function essentially as ordinary snow boots for walking.

Strap bindings, however, can be difficult to release, since typically two over-the-boot straps must be unfastened on each boot. Accordingly, step-in bindings have been developed, both for hard- and soft-boot snowboard riding. Step-in hard bindings are similar to their counterparts for alpine skiing. With step-in bindings developed for freestyle riding, fittings on the base (i.e., that part including the sole and lower heel) of the boots releasably engage with braces mounted to the board.

One type of step-in soft binding system comprises a snowboard-mounted brace to which a highback element is attached. As with strap-in binding systems, soft boots are used with the step-in binding including a highback. Herein, the highback element can include adjustable lean-setting means. On the other hand, the need for lateral heel support in joining the highback to the step-in baseplate renders it impracticable to make the highback pivotable in such step-in bindings.

In another type of step-in binding/stance support system ("freestyle step-in system" hereinafter) there is no highback support element attached to the board-mounted baseplate; instead, the highback support is made part of the boot itself, either integral with or on the outside of the highback region of the boot. Consequently, the boots are semi-rigid rather than soft. On the other hand, unlike hard boots for alpine skiing, boots designed for use in freestyle step-in systems are constructed to provide lateral flexibility between the bootleg and heel portions.

Configurations of freestyle step-in system systems furthermore are known that provide lean adjustment. Wherein this is the case, it is desirable at the same time to provide the system with some means for disengaging the lean adjustment, to provide, as it is called in the art, "on/off switching" between the "ride/walk" modes. This permits the rider to be able to walk in the snowboard boots after dismounting from the board, since otherwise the boots would be fixed in a set lean, not allowing the flexibility at the ankle necessary for walking, with strap bindings, since as mentioned previously the highback is attached to the, binding, "walk mode" is achieved simply by unstrapping the boot from the binding, regardless of whether a lean adjustment is built into the binding/stance support system.

An example of a freestyle step-in system with lean adjustment means which is at the same time on/off switchable between the ride and walk modes is disclosed in the 1998/1999 K2 Snowboards Inc. dealer catalog, wherein a forward lean engagable and disengagable "freestyle outsole" is illustrated.

With freestyle step-in systems also the highback support element can incorporate canting support means as well as adjustable lean-setting means, for example, as taught in European Pat. Appl. Publ. No. EP 0 772 982 A2, commonly assigned to the present applicant. Therein, furthermore, the canting support means is unilaterally restricted to provide the afore-described asymmetrical highback support.

Accordingly, highback support elements in freestyle step-in system systems are known to be fitted with means for regulatively supported canting of the log portion with respect to the base portion of the boot, in addition to lean adjustment.

Nevertheless, freestyle step-in system systems constructed for canting highback support as well as adjustable lean support that at the same time can be readily switched between the ride/walk modes would be especially desirable.

Still more desirable would be such a freestyle step-in system that also is attachable to any step-in directed boot.

SUMMARY OF THE INVENTION

It is an object of the present invention for a freestyle step-in snowboard boot to construct a stance support system that has a lean adjustment capability, regulatively supports canting, and at the same time is readily switchable between ride and walk modes.

It is a further object of the invention to configure such a stance support system as an attachment having a simplified structure, in particular with regard to the heeloriented portion thereof, wherein the stance support system is attachable to any step-in directed boot and is effective independently of the boot binding system apart from the attachment.

Accordingly, in a principal embodiment the present invention comprises a stance support shank, a bearing, and a shank retainer fitting. The bearing is structured for mounting on the heel portion of a snowboard boot and is formed to have a bearing surface that is at least partially pivotal. One end of the shank is formed as a rocker for riding on the pivotal surface of the bearing and the other end is a lever end engagable into the retainer fitting. The retainer fitting is for mounting on the leg portion of the snowboard boot and is configured to retain the support shank such that it is switchable between ride and walk modes.

In the principal embodiment the bearing surface further is formed to constitute a stop, such that wherein the stance support attachment in accordance with the present invention is mounted onto a snowboard boot, the rocker end of the shank is rockable from the upright orientation along the highback region of the boot through an instep-ward cant, and is rigidly restrained in the upright orientation from rocking outward beyond the cant.

Furthermore, in the principal embodiment, the lever end of the shank is readily disengagable from the retainer fitting, and since the rocker end riding on the pivotal bearing surface can readily be withdrawn, the stance support shank is entirely removable from the boot attachment, wherein the snowboard boot is put into the walk mode.

The stance support attachment according to the present invention is configured to have a lean adjustment; in the principal embodiment the lean adjustment is a mechanism associated with the engagement of the retainer fitting and the lever end of the support shank. Therein, either the retainer fitting itself as mounted onto the leg portion of the snowboard boot, the lever end of the shank, or both can be configured to be adjustable lengthwise of the shank such that the linear distance between the lever end of the shank as engaged into the retainer fitting, and the pivotal surface of the bearing, is extensible and retractable.

Alternatively, the lean adjustment can be furnished in the bearing mount, wherein the pivotal bearing surface can be constructed to be movable in the longitudinal direction of the shank to enable adjustable setting of the linear distance between the pivotal bearing surface and the retainer fitting as mounted on the leg portion of the snowboard boot.

The rocker end of the shank in the principal embodiment rides on the pivotal bearing surface retained by a rear peripheral catch on the bearing protruding upright beyond the pivotal surface. In alternative embodiments, the rocker end of the shank is retained in riding on the bearing by a locking pin, a wing lever, etc. Furthermore, the pivotal bearing surface can be constituted by the cylindrical surface of a bolt, in which case the head of the bolt may serve to retain the rocker end of the shank in riding on the bolt. In this latter came, the rocker end of the shank is embodied to entirely encompass the cylindrical bearing surface, wherein the rocker end is restrained to be partially pivotal by an appropriate stop surface. The stop therein can be a bearing surface as in the principal embodiment, in which case the rocker end of the shank is configured with a matching stop surface; or the stop may be an extension of a mounting portion of the bearing, lateral of the support shank, wherein the stop restrains the shank against outward cant.

In an alternative embodiment of the present invention, the retainer fitting is spring-hinged such that with the lever end of the shank engaged into the retainer fitting, it can be swung between, and elastically held into, the bearing-riding position, wherein the rocker end of the shank rides on the pivotal bearing surface, and a diametrically opposite walk-mode position, wherein the lever end is retained out of the way.

The foregoing and other objects, features, aspects and advantages of the present invention will become more apparent from the following detailed description, when taken in conjunction with the accompanying drawings.

BRIEF DESCRIPTION OF THE DRAWINGS

FIG. 2*a* is an enlarged partial view corresponding to

FIG. 1, illustrating details of the lever end of a shank of the stance support attachment;

DETAILED DESCRIPTION OF THE PREFERRED EMBODIMENTS

Figure 1:
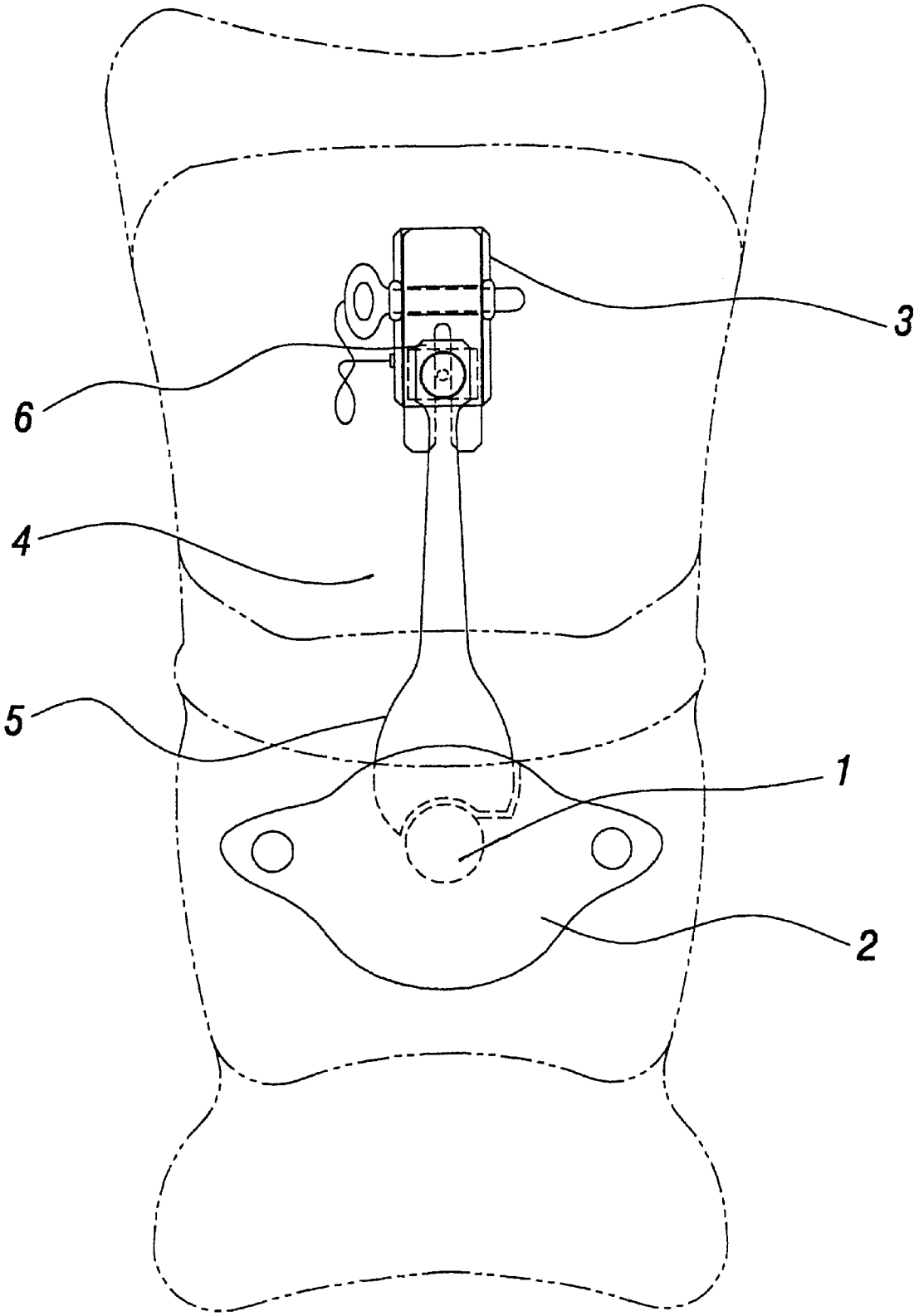
FIG. 1 is a rear elevation depicting a stance support attachment for a snowboard boot in installation according to a principal embodiment of the present invention.

The general structure of a stance support system for a snowboard boot in a principal embodiment of the present invention is illustrated in FIG. 1. The snowboard boot (indicated in phantom in the figure) is directed to a freestyle step-in binding, and accordingly the sole of the boot is fitted with a fastening mechanism (not indicated). The stance support system comprises a bearing 1 retained in a bearing mount 2 that is configured for attachment to the heel portion of the snowboard boot, a shank retainer fitting 3, and a support shank 4. The shank is formed with a rocker end 5 that rides on the bearing 1 when the stance support system is in the ride mode, and a lever end 6 that is removably retained by the shank retainer fitting 3.

Figure 2A:
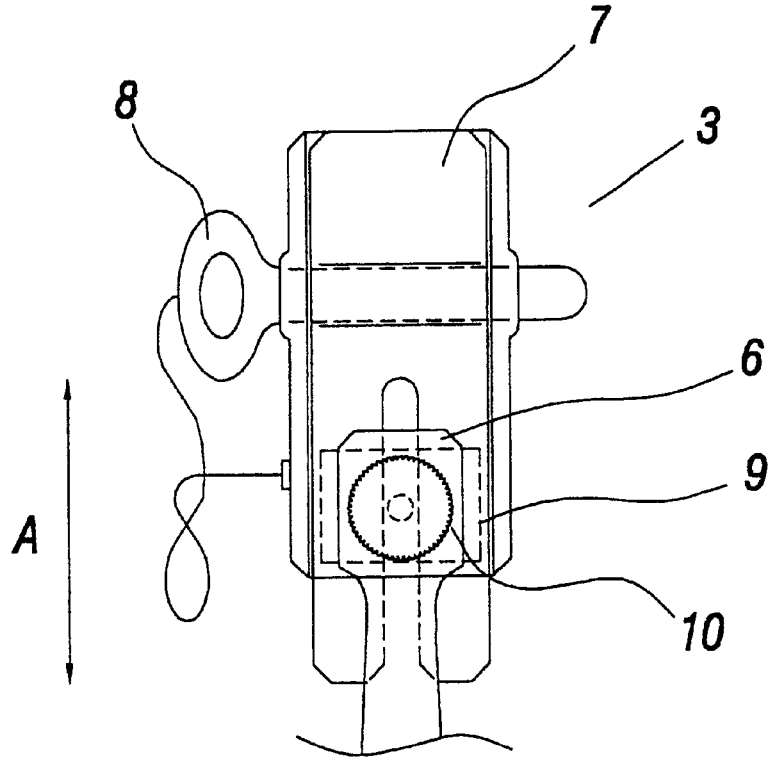

In the principal embodiment of the invention, the lever end 6 of the support shank 4 as illustrated in FIG. 2*a* is engaged into a shank retainer 7 fastened into the shank retainer fitting 3 by a removable locking pin 9 or similar mechanism. Further, a lean adjustment in this embodiment is provided on the lever end 6 of the support shank 4, and comprises an adjuster plate 9 and adjusting screw 10 for retaining the lever end 6 in an adjustment slot 7*a* (FIG. 5*a*), or like mechanism whereby the lever end 6 of the support shank 4 is fixedly positionable along the direction of the arrow A in the figure.

Figure 2B:
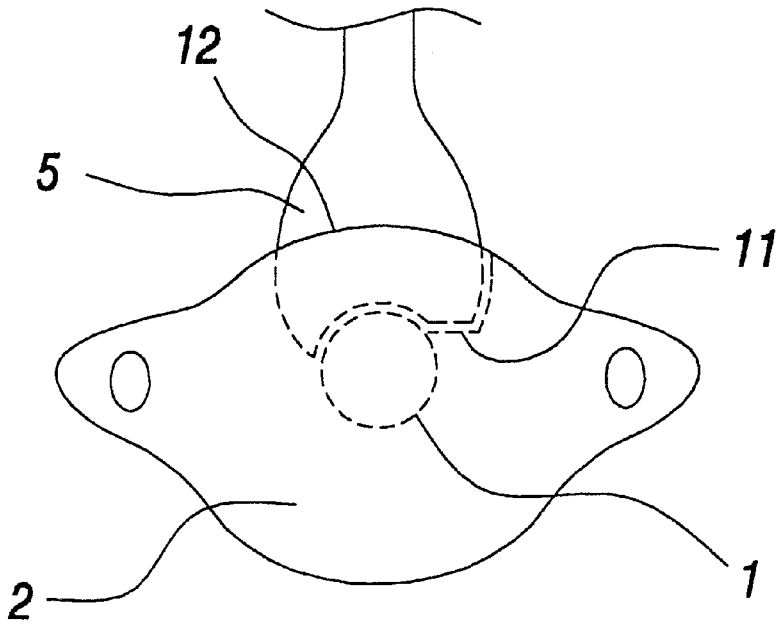
FIG. 2*b* is an enlarged partial view corresponding to FIG. 1, illustrating details of the rocker end of the shank support, riding on a pivotal bearing surface.
Figure 3:
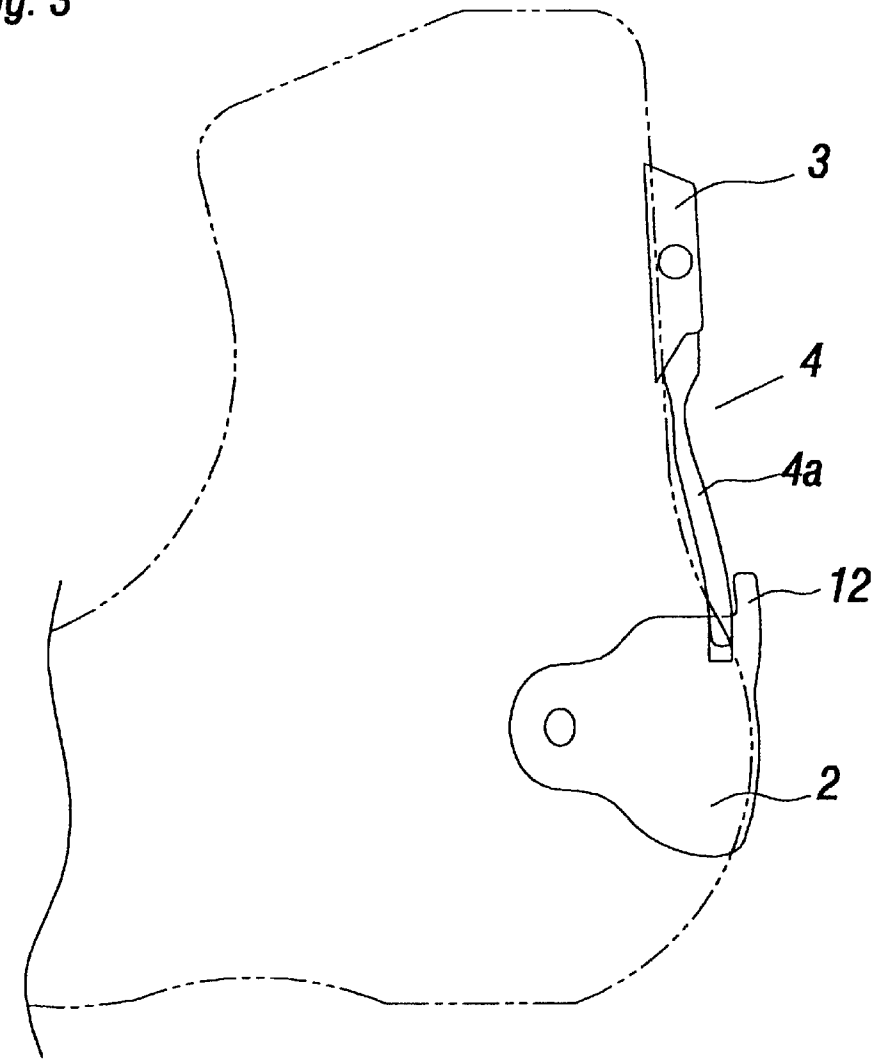
FIG. 3 is lateral view of the stance support attachment illustrated in FIG. 1, in particular depicting a catch on the bearing according to the principal embodiment.

FIG. 2*b* illustrates a bearing stop 11 formed on the outward canting side of the pivotal surface of the bearing 2, and a catch 12 formed peripherally on the rear end of the bearing mount 2, protruding upright beyond the bearing 1. The catch 12 is shown laterally in FIG. 3, wherein the stance support system in the present embodiment is further depicted in installation on a snowboard boot, indicated in phantom. FIG. 3 further shows that the support shank 4 can have a centrally curved conformation, indicated by 4*a* in both FIG. 3 and in the FIG. 4 enlarged oblique view of the shank, such that the stance support system follows the highback portion of the boot in a low profile.

Figure 4:
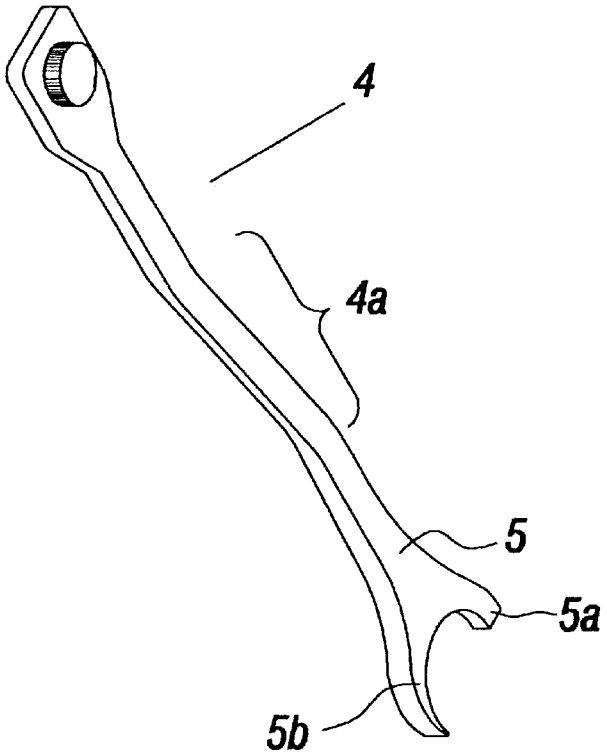
FIG. 4 is an oblique enlarged view of the support shank according to the principal embodiment.

FIG. 4, in addition to illustrating this curved conformation possible for the support shank 4, further illustrates a rocker stop Ba formed on the rocker end of the support shank 4, stopping on the bearing stop 11, and a pivoting portion 5*b* that rides on the pivotal surface of the bearing 1.

In this embodiment accordingly, the support shank 4 is completely detachable from the stance support system by unfastening the lever end 6 from the shank retainer fitting 3, meanwhile withdrawing the rocker end 5 from behind the catch 12, off the bearing 1.

Figure 5A:
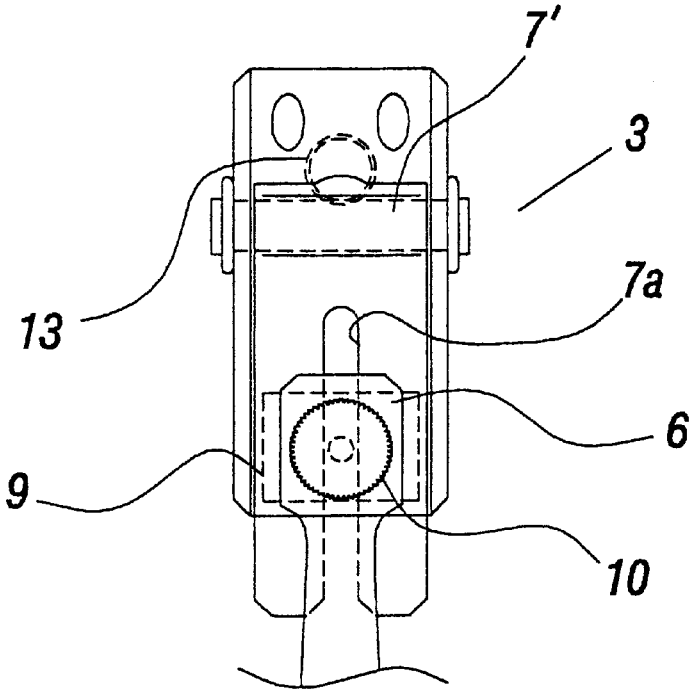
FIG. 5*a* is a plan showing details of the lever end of the support shank engaged with a hinged retainer fitting constructed to have a lean adjustment in an alternative embodiment of the present invention.
Figure 5B:
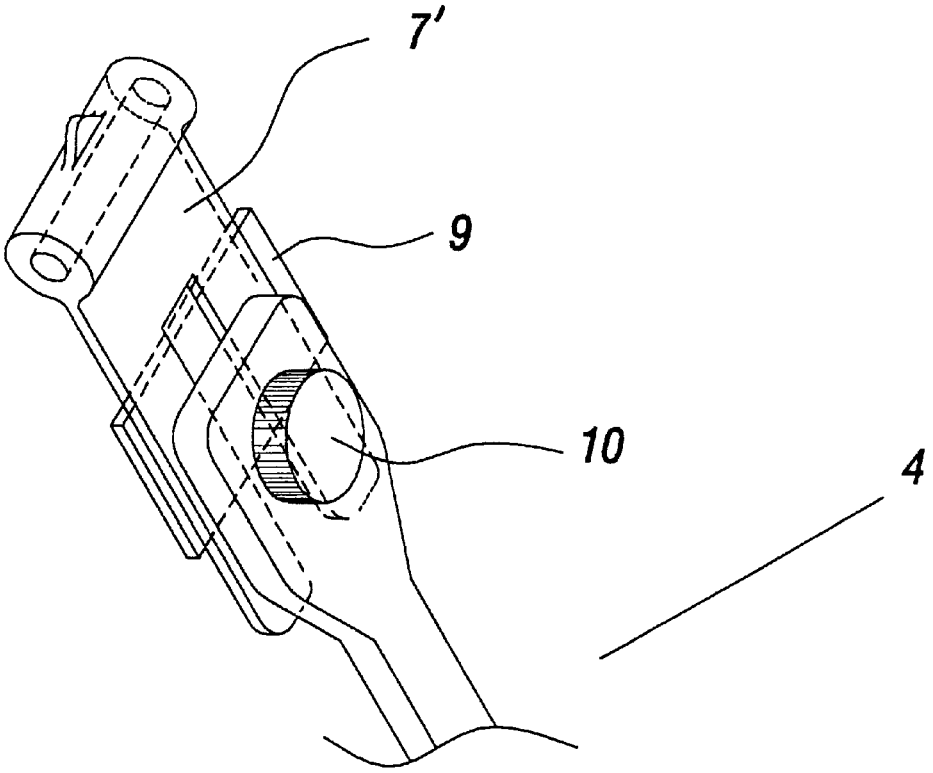
FIG. 5*b* is an enlarged oblique view of the lever end of the support shank fitted for engagement with the hinged retainer fitting illustrated in FIG. 5*a;*
Figure 6:
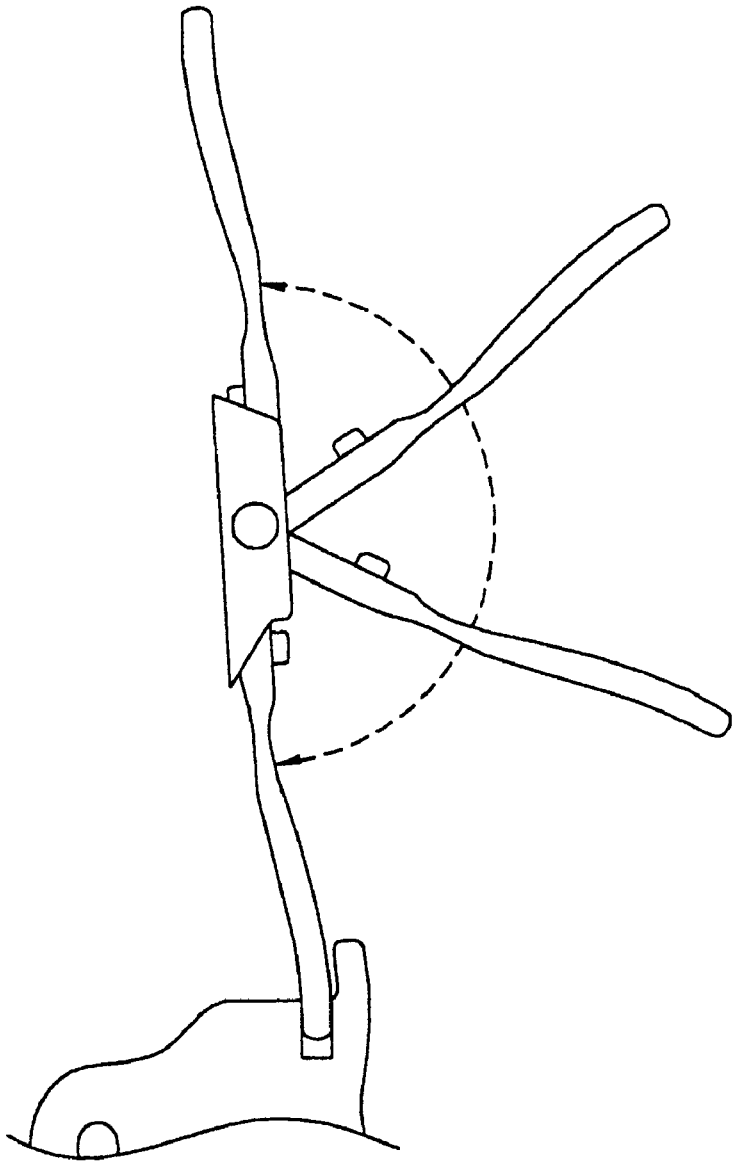
FIG. 6 is a lateral view of the stance support attachment, schematically illustrating swinging of the support shank between ride and walk modes of the system, according to the embodiment depicted in FIG. 5.

In an alternative embodiment, the shank retainer fitting 3 as illustrated in FIG. 5*a* can be toggle spring-hinged. A toggle-spring hinge 7' portion of the shank retainer 7 is configured for toggle-switch like engagement with an expansion spring 13. The shank retainer 7 therein is not removable, but with the lever end 6 of the support shank 4 engaged into the toggle spring-hinged shank retainer fitting 3, the support shank 4 can be swung between a bearing-riding, i.e., ride-mode position, wherein the rocker end 5 of the support shank 4 rides on the pivotal surface of the bearing 1, and a diametrically opposite walk-mode position, in which the lever end 6 is out of the way. Accordingly, as indicated schematically in FIG. 6, the spring hinge 7' in this embodiment elastically retains the support shank 4 in both the ride- and walk-mode (diametrically opposed) positions.

Figure 7A:
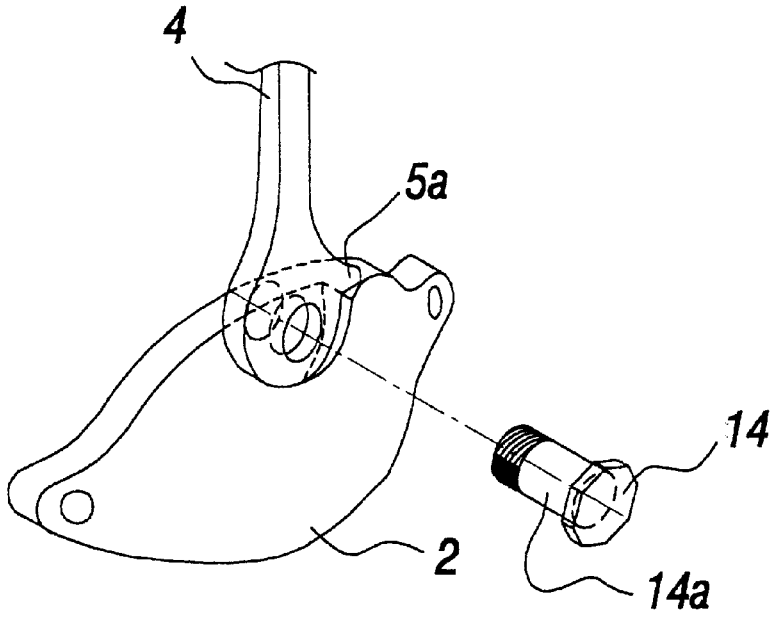
FIG. 7*a* is an oblique view illustrating an alternative configuration of the rocker end of the support shank and correspondingly of the bearing, shown exploded from the rocker end and bearing mount, in another embodiment of the snowboard boot stance-support system according to the present invention FIG. 7*b* corresponds to FIG. 7*a,* but illustrates an alternative configuration of a bearing stop associated with the rocker end of the support shank in the embodiment illustrated in FIG. 7*a;*
Figure 7B:
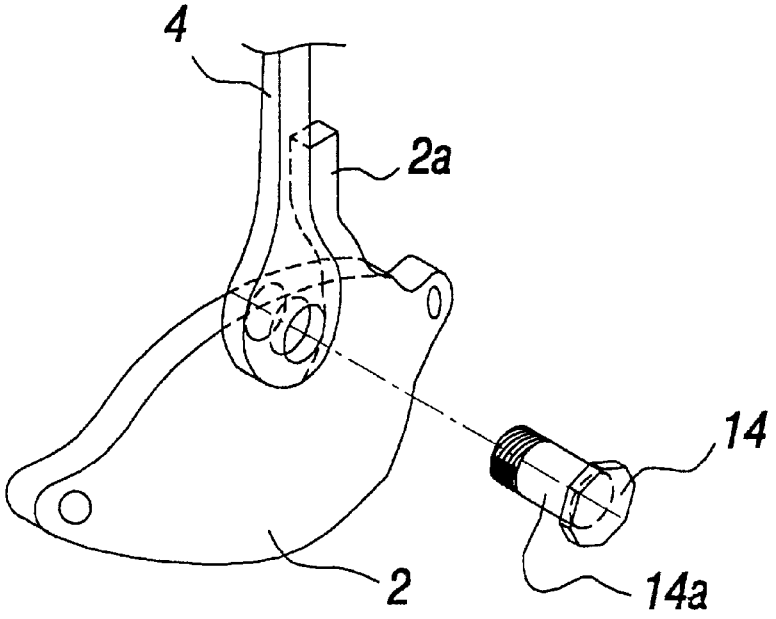
Figure 8:
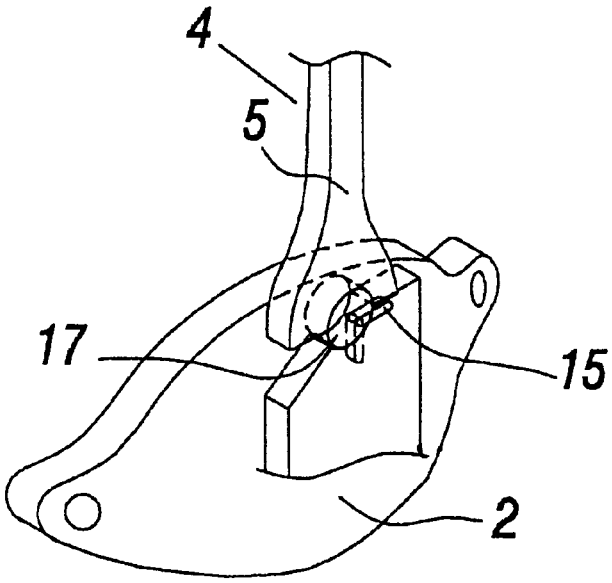
FIG. 8 illustrates the rocker end of a support shank in accordance with yet another embodiment of the invention, further depicting a wing-lever retainer as an alternative configuration for supporting the rocker end in any of several configurations of the rocker end and bearing in their engagement.

Various configurations of the rocker end 5 of the support shank 4 in its riding engagement with the bearing 1 are possible, for example as illustrated in FIGS. 7*a*, 7*b*, and 8. AS shown in FIGS. 7*a* and 7*b,* the rocker end 5 of the support shank 4 is formed to entirely encompass the bearing 1 which in this case is constituted as a fully pivotal cylindrical surface.

Furthermore, in the embodiment illustrated in FIGS. 7*a* and 7*b,* the fully pivotal bearing surface can be constituted by the cylindrical surface of a bolt 14, shown exploded from the rocker end 5 of the shank 4 and bearing mount 2, in which case the bearing is itself removable, and furthermore the head of the bolt 14*a* can retain the rocker end 5 in riding on the bolt 14.

Accordingly, the rocker end 5 is restrained to be partially pivotal by an appropriate stop. In the example shown in FIG. 7*a,* a stop surface 5*a,* formed on the rocker end 5, is configured to match a stop surface on the bearing mount 2 as in the principal embodiment.

Alternatively, as shown in FIG. 7*b,* the stop may be formed as an extension 2*a* of the bearing mount 2, lateral of the support shank 4, wherein the extension 2*a* restrains the shank 4 against outward cant.

The rocker end 5 of the shank 4 can be retained in riding on the bearing 1 by a wing lever 15, as illustrated in FIG. 8, or by a locking pin, etc. (not illustrated in the figures). FIG. 8 further illustrates that accordingly that the bearing 1 can have an alternatively configured bearing surface 17, as correspondingly can the rocker end 5.

Other possible configurations of the pivotal surface of the bearing 1, of the bearing mount 2, of the rocker end 5 of the shank 4 in riding on the bearing 1, and of the associated stops on the rocker end 5 and/or the bearing 1 and bearing mount 2 are possible, and consequently the present invention is not limited to those herein described and depicted.

It is preferable that the canting pivotal axis pass approximately through the region of the user's ankle; therefore in the preferred embodiment, the lean adjustment is provided in the lever end 6/shank retainer fitting 3, as afore-described. Nonetheless, the lean adjustment in an alternative embodiment can be furnished on the bearing 1.

Figure 9:
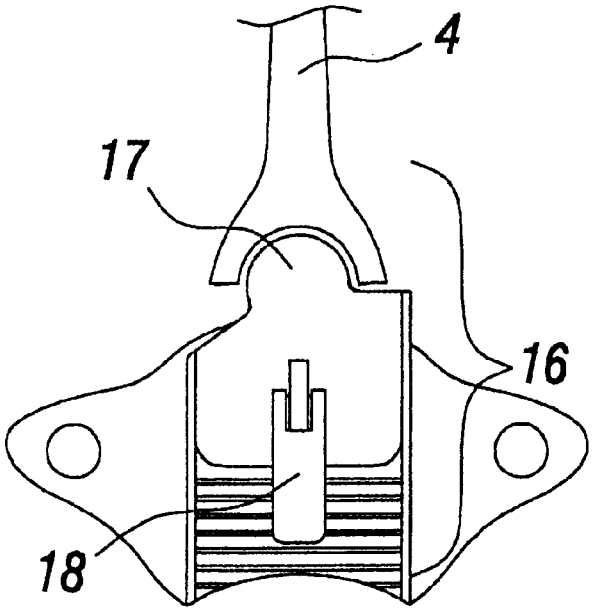
FIG. 9 illustrates a pivotal bearing surface adjustment mechanism in a still further embodiment of the invention, wherein the support shank rocker end corresponds the configuration depicted in FIG. 8.

FIG. 9 illustrates such an alternative lean adjustment 16, furnished in the bearing mount. The pivotal bearing surface 17 is therein constructed to be positionable in the longitudinal direction of the shank 4. Accordingly, the lean of the stance support system in this embodiment is adjusted by setting the pivotal bearing surface 17 further toward or further away from and the retainer fitting 3 with a locking adjustment lever 18.

Note that the rocker end 5 of the support shank 4 as depicted in FIG. 9 is configured as that depicted in FIG. 8, wherein the bearing surface 17 is formed to be partially pivotal accordingly.

As described in the foregoing, a stance support system in accordance with the present invention for a snowboard boot is an attachment having a simplified structure, wherein the stance support system is attachable to any step-in directed boot since it functions independently of any vamp or over-the-ankle strap binding or lean adjusting fittings, and requires no ankle-flanking support structures.

The stance support system accordingly provides for lean adjustment, supports inward canting and restrains against outward canting to promote the maintenance of steering power contact between the sole of the boot and the snowboard, and meanwhile is readily switchable between the ride/walk modes.

It is a matter of course that right and left stance supports are configured complementarily.

Various details of the present invention may be changed without departing from its spirit nor its scope. Furthermore, the foregoing description of the embodiments according to the present invention are provided for illustration only, and not for the purpose of limiting the invention as defined by the appended claims and their equivalents.

What is claimed is:

1. A stance-support system for a boot fitted for fastening into a snowboard binding, the stance-support system comprising:

a bearing mount formed with a stop, said bearing mount supporting a cylindrical element, at least a portion of said cylindrical element defining a pivotal bearing surface, said bearing mount being adapted for attachment to a snowboard boot heel portion;

a link retainer for attachment to a leg portion of the snowboard boot; and a link for riding on said pivotal bearing surface, said link having a rocker end formed for rocking on said pivotal bearing surface and a lever end for engagement with said link retainer, wherein at least said rocker and of said link is detachable from said bearing mount and said bearing mount is further formed with a catch for releasably retaining said rocker end of said link in contact with said bearing surface.

2. A stance-support system according to claim 1, wherein said bearing surface bears said rocker end such that said link is pivotable about said cylindrical element from a generally upright position with respect to the leg portion of the snowboard boot in a first canting direction instep-ward of the boot and is rigidly restrained in the generally upright position against pivotable movement in a second canting direction opposite said first canting direction.

3. A stance-support system according to claim 1, wherein said link retainer detachably engages said lever end of said link such that said link is completely detachable from said link retainer.

4. A stance-support system according to claim 1, wherein said link retainer is spring-hinged such that said lever end of said link in engagement with said link retainer is spring-hinge retentively switchable between a bearing-riding position and a disengaged position.

5. A stance-support system according to claim 1, further comprising an adjustment mechanism associated with said link retainer and said lever end of said link, whereby said lever end is extensible and retractable with respect to said link retainer.

6. A stance-support system according to claim 1, wherein said bearing mount comprises a position-adjusting mechanism for adjustably positioning said cylindrical element uprightly with respect to the snowboard boot heel.

7. A stance-support system according to claim 3, wherein said link retainer comprises a releasable locking pin for retaining said lever end of said link on said link retainer.

8. A stance-support system according to claim 1, wherein said cylindrical element is a removable bolt whereby said rocker end of said link rides on said bolt retained in a bearing-riding position.

9. A stance-support system, according to claim 1, wherein said bearing mount comprises an external heel counter.

10. A stance-support mechanism for a boot comprising:

a bearing mount for attachment to a counter portion of a snowboard boot;

a bearing retained by said bearing mount, said bearing having a bearing surface;

a link retainer for attachment to a highback portion of the snowboard boot above said bearing mount, said link retainer including a pivot pin;

a link having a lever end and a rocker end, said rocker end adapted for contact with said bearing surface, said lever end supported on said link retainer by said pin, said link being pivotable about said pin such that said rocker end is moveable between a bearing-riding position with said rocker end contacting said bearing surface and a disengaged position with said rocker end moved upward, and away from said bearing surface;

a lean adjustment mechanism coupled to said link, said lean adjustment mechanism being adapted to adjust linear separation between said link retainer and said bearing mount with said rocker end in said bearing-riding positions said bearing; and wherein said bearing mount and said rocker end are adapted such that with said rocker end in said bearing-riding position, said link is pivotable about said bearing from a generally upright position with respect to the highback portion of the snowboard boot in a first canting direction with respect to the boot and said link is rigidly restrained in the generally upright position against pivoting movement in a second canting direction opposite said first canting direction, and wherein said link retainer is spring-hinged such that said lever end of said link is retentively switchable between said bearing-riding position and said disengaged position.

11. A stance-support mechanism according to claim 10, wherein said link retainer detachably engages said lever end of said link such that said link is completely detachable from said link retainer.

12. A stance-support mechanism according to claim 10, wherein said lean adjustment mechanism is attached to said bearing mount.

13. A stance support mechanism according to, claim 10, wherein said lean adjustment mechanism is attached to said link retainer.

14. A stance support mechanism according to claim 10,wherein said bearing is a removable bolt retained in said bearing mount, whereby said rocker end of said link contacts said bolt retained in said bearing-riding position.

15. A stance-support mechanism for a boot comprising:

a bearing mount for attachment to a counter portion of a snowboard boot;

a bearing retained by said bearing mount, said bearing having a bearing surface;

a link retainer for attachment to a highback portion of the snowboard boot above said bearing mount, said link retainer including a pivot pin;

a link having a lever end and a rocker end, said rocker end adapted for contact with said bearing surface, said lever end supported on said link retainer by said pin, said link being pivotable about said pain such that said rocker end is moveable between a bearing-riding position with said rocker end contacting said bearing surface and a disengaged position with said rocker end moved upward and away from said bearing surface;

a lean adjustment mechanism coupled to said link, said lean adjustment mechanism being adapted to adjust linear separation between said link retainer and said bearing mount with said rocker end in said bearing-riding position on said bearing;

wherein said bearing mount and said rocker end are adapted such that with said rocker end in said bearing-riding position, said link is pivotable about said bearing from a generally upright position with respect to the highback portion of the snowboard boot in a first canting direction with respect to the boot and said link is rigidly restrained in the generally upright position against pivoting movement in a second canting direction opposite said first canting direction; and wherein said bearing mount includes a catch for releasably retaining said rocker end of said link in said bearing-riding position.

* * * * *